US006615899B1

(12) United States Patent
Woodward et al.

(10) Patent No.: US 6,615,899 B1
(45) Date of Patent: Sep. 9, 2003

(54) METHOD OF CASTING A METAL ARTICLE HAVING A THINWALL

(75) Inventors: John M. Woodward, Avondale, AZ (US); Tom Miller, Phoenix, AZ (US); Candy Mitchell, Peoria, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/194,479

(22) Filed: Jul. 12, 2002

(51) Int. Cl.[7] ..... B22D 27/15

(52) U.S. Cl. ..... 164/61; 164/63; 164/122; 164/122.1; 164/516; 164/45; 164/34

(58) Field of Search ..... 164/61, 63, 122, 164/122.1, 516, 45, 253, 256, 338.1, 361, 235, 34

(56) References Cited

U.S. PATENT DOCUMENTS

| | | | | | |
|---|---|---|---|---|---|
| 4,438,065 | A | * | 3/1984 | Brown | 264/335 |
| 4,716,639 | A | | 1/1988 | Readman | 29/890.14 |
| 4,724,891 | A | | 2/1988 | Brookes | 164/122.1 |
| 4,809,764 | A | | 3/1989 | Prasad | 164/122.1 |
| 5,072,771 | A | * | 12/1991 | Prasad | 164/122.1 |
| 5,295,530 | A | | 3/1994 | O'Connor | 164/516 |
| 5,381,851 | A | * | 1/1995 | Bliz et al. | 164/119 |
| 5,529,645 | A | | 6/1996 | Oswalt | 148/549 |
| 5,545,003 | A | | 8/1996 | O'Connor | 415/115 |
| 5,577,547 | A | * | 11/1996 | Hosamani | 164/122 |
| 5,641,014 | A | | 6/1997 | O'Connor | 164/516 |
| 5,810,552 | A | | 9/1998 | Frasier | 415/115 |
| 5,924,483 | A | | 7/1999 | Frasier | 165/154 |
| 6,050,325 | A | | 4/2000 | Wheaton | 164/516 |
| 6,071,363 | A | | 6/2000 | O'Connor | 148/559 |
| 6,186,217 | B1 | | 2/2001 | Sikkenga | 164/137 |
| 6,244,327 | B1 | * | 6/2001 | Frasier | 164/34 |
| 6,255,000 | B1 | | 7/2001 | O'Connor | 428/586 |
| 6,347,660 | B1 | | 2/2002 | Sikkenga | 164/137 |

* cited by examiner

*Primary Examiner*—Tom Dunn
*Assistant Examiner*—I.-H. Lin
(74) *Attorney, Agent, or Firm*—Robert Desmond, Esq.

(57) ABSTRACT

A method of casting a metal article comprising the steps of forming a mold having a mold cavity with a height, a thinwall portion and a base wall portion. The thinwall portion may be less than 0.05 inches thick and free of gating. The method comprises the steps of: positioning the mold in a preheated furnace so that the furnace substantially surrounds the mold and so that a longitudinal axis of the long thin portion of the mold cavity is in an upright orientation; heating the mold in the furnace to a temperature between 1045° C. and 1055° C.; and drawing a vacuum in the furnace. The metal is heated until it is molten and is then poured at a temperature between 1560° land 1570° C. into the mold cavity. The vacuum is then broken and the mold cavity withdrawn from the furnace. The molten metal is allowed to solidify in the mold cavity so that it will solidify with a equiaxed grain structure.

20 Claims, 4 Drawing Sheets

METHOD OF CASTING A METAL ARTICLE HAVING A THINWALL

GOVERNMENT RIGHTS

This invention was made with Government support under Contract No. GS10F0133J awarded by AMCOM. The Government has certain rights in this invention.

BACKGROUND OF THE INVENTION

The present invention generally relates to a method of casting a metal article having a long thin portion. More particularly the present invention relates to a method of casting thinwall metal articles that is single-cast, allows for high temperatures, is quick, relatively inexpensive, not labor intensive, improves current quality and may use traditional equiaxed investment casting technology.

It is known within the art to form thinwalls by providing metal which has been cold rolled to a very thin thickness. The cold-rolled metal is then etched or machined to provide small holes in the surface. The metal is then formed and bonded in a curved shape to produce the particular desired part. The forming process may result in the distortion of holes in the wall.

Long thin articles have also previously been cast with a directionally solidified or columnar grained crystallographic structure. Using this method, the mold is preheated to a relatively high temperature which is above the liquidus temperature of the metal of which the cast article is to be formed. Super heated molten metal is then poured into the preheated mold, with heat being supplied during pouring so that the metal remains molten during and immediately after pouring. The molds have gates placed at various locations along the length of the mold. This gating is used to conduct molten metal which compensates for the decrease in the volume of the metal during solidification.

The use of a directionally solidified or columnar grained crystallographic structure is known within the art. U.S. Pat. No. 4,724,891, incorporated herein by reference, provides a method of casting a thinwall using a directionally solidified furnace. A mold having a cavity with a configuration corresponding to the desired configuration of the cast is formed. The mold cavity has a thinwall forming portion in which major side surfaces of the mold are spaced apart by a distance, 0.05 inches or less, corresponding to the desired thickness of the thinwall portion of the article. After the mold has been preheated to a temperature close to the melting temperature of the metal which is to be cast, molten metal is poured into the mold. While the molten metal is being poured, the mold is heated so that molten metal can completely fill the mold cavity. After filling the mold cavity, the molten metal in the thinwall forming portion of the mold cavity is solidified to form a continuous solid body having a configuration corresponding to the configuration of the thinwall portion of the article. To prevent the formation of voids as the molten metal solidified, the molten metal is solidified in one direction by moving an interface between molted and solid metal in one direction through the thinwall forming portion of the mold cavity. The direction of solidification of the molten metal through the thinwall forming portion of the mold cavity is toward the gating or end portion of the mold may cavity into which the molten metal was originally conducted.

U.S. Pat. No. 6,244,327, herein incorporated by reference, discloses a method of making single-cast, high temperature thinwall structures having a high thermal conductivity member connecting the walls. This process controls the uses a pressurized, directionally solidified furnace and controls the injection pressure of an alloy in order to solve the problem of creep of a ceramic shell. This process is complicated in that it utilizes conductivity rods and/or connectivity pins.

Gas turbine engines are continually being improved, requiring higher operating temperatures. As an example, the combustion chamber, which to date has been required to maintain strength at temperatures up to about 1300–1400° F., is now being designed to operate at temperatures of about 1600° F. or greater where creep is critical. In the past, metal articles where manufactures from convention cobalt-based or nickel-based alloys. These materials were chosen because of their sufficient strength and physical characteristics. Many conventional designs are fabricated from sheet stock or alternatively machined from wrought material. However, these techniques can be relatively expensive due to the extensive working required to form the thinwalled shape and because of the number of structural welds. Also, directional solidification processes take a great deal of time, resulting in higher costs, and the metal gets too cold too quickly, resulting in large holes.

As can be seen there is a need for a method of producing thinwall structures that is single-cast, allows for high temperature, thinwall structures which is quick, relatively inexpensive, not labor intensive, improves current quality and may use traditional equiaxed investment casting technology.

SUMMARY OF THE INVENTION

In one aspect of the invention, a method is disclosed for casting a metal article comprising the steps of forming a mold having a mold cavity with a height, a thinwall portion and a base wall portion. The base wall portion may have a thickness less than 10 times the thickness of the thinwall portion and at least one gate. The thinwall portion may be less than 0.05 inches thick and free of gating. The method comprising the steps of: positioning the mold in a preheated furnace so that the furnace substantially surrounds the mold and so that a longitudinal axis of the long thin portion of the mold cavity is in an upright orientation; heating the mold in the furnace to a temperature between 1045° C. and 1055° C., and drawing a vacuum in the furnace. The metal is heated until it forms a molten metal and poured at a temperature between 1560° and 1570° C. into the mold cavity. The vacuum is broken and the mold cavity withdrawn from the furnace. The molten metal is allowed to solidify in the mold cavity solidify with a equiaxed grain structure.

In another aspect of the present invention a method for casting a metal articles is disclosed, comprising the steps of injecting investment casting wax into a metal wax injection die to form a wax assembly, repeatedly dipping the wax assembly in a ceramic slurry and allowing to dry at least two times. This results in a mold with a mold cavity having an outer diameter, height, thinwall portion, a base wall portion with at least two gates. The thinwall portion may be less than 0.05 inches thick and free of gating. The mold is then cleaned, burned and coated. Then the mold may be positioned in a preheated furnace so that the furnace substantially surrounds the mold and so that a longitudinal axis of the long thin portion of the mold cavity is in an upright orientation. The mold is heated to a temperature that may be between 1045 and 1055° C. A vacuum is drawn in the furnace and a metal heated until it forms a molten metal. The metal may then be poured into the mold cavity. The vacuum is then broken and the mold removed. Inside the mold the molten metal is allowed to solidify so as to form a metal article with a equiaxed grain structure.

In yet another aspect of the present invention a method is disclosed for casting a metal combustion case, comprising the steps of injecting investment casting wax into a metal wax injection die to form a wax assembly, washing said wax assembly, drying the wax assembly, dipping the wax assembly in a primary coat, allowing the primary coat to dry, dipping the wax assembly in at least one backup coat, allowing the backup coat to dry, resulting in a mold with a mold cavity having an outer diameter between 12 and 22 inches, a height between 5 and 10 inches, a thinwall portion with a thickness less than 0.35 inches and free of gating, a base wall portion with a thickness less than 0.30 inches with twelve gates and twelve atomisers, wherein the gates may be between the twelve atomisers. The mold may then be placed in a Boilverclave, then in a Dewax kiln. The mold may then coated with a final coat and wrapped in Kerlane. The mold may be positioned in a preheated furnace so that the furnace substantially surrounds the mold and so that a longitudinal axis of the long thin portion of the mold cavity is in an upright orientation and heated to a temperature between 1045° C. and 1055° C. A vacuum may be drawn, and a nickel based alloy metal heated until it forms a molten metal, this molten metal may be poured at a temperature between 1560° C. and 1570° C. into the mold cavity, the vacuum broken and the mold withdrawn. The molten metal may be allowed to solidify so as form a combustion case metal article with a equiaxed grain structure.

In yet another aspect of the present invention, a method for casting a metal combustion case for use within a gas turbine engine is disclosed comprising the steps of injecting investment casting wax into a metal wax injection die to form a wax assembly, washing the wax assembly, drying the wax assembly, dipping the wax assembly in a primary coat, allowing the primary coat to dry, dipping the wax assembly in at least one backup coat and allowing said backup coat to dry. This results in a mold with a mold cavity having a height, a thinwall portion less than 0.05 inches thick and free of gating and a base wall portion with a thickness less than 10 times the thickness of the thinwall portion and having at least one gate. The mold is placed in a Boilverclave, then in a Dewax kiln. Then the mold may be coated with a final coat and wrapped in Kerlane. The mold may then be positioned in a preheated furnace so that the furnace substantially surrounds the mold and so that a longitudinal axis of the long thin portion of the mold cavity is in an upright orientation. The mold is heated in said furnace to a temperature between 1045° C. and 1055° C., a vacuum may be drawn, and molten metal poured at a temperature between 1560° C. and 1570° C. into the mold cavity. The vacuum is then broken and the mold withdrawn, so as to cause said molten metal to solidify to form a metal article with a equiaxed grain structure.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
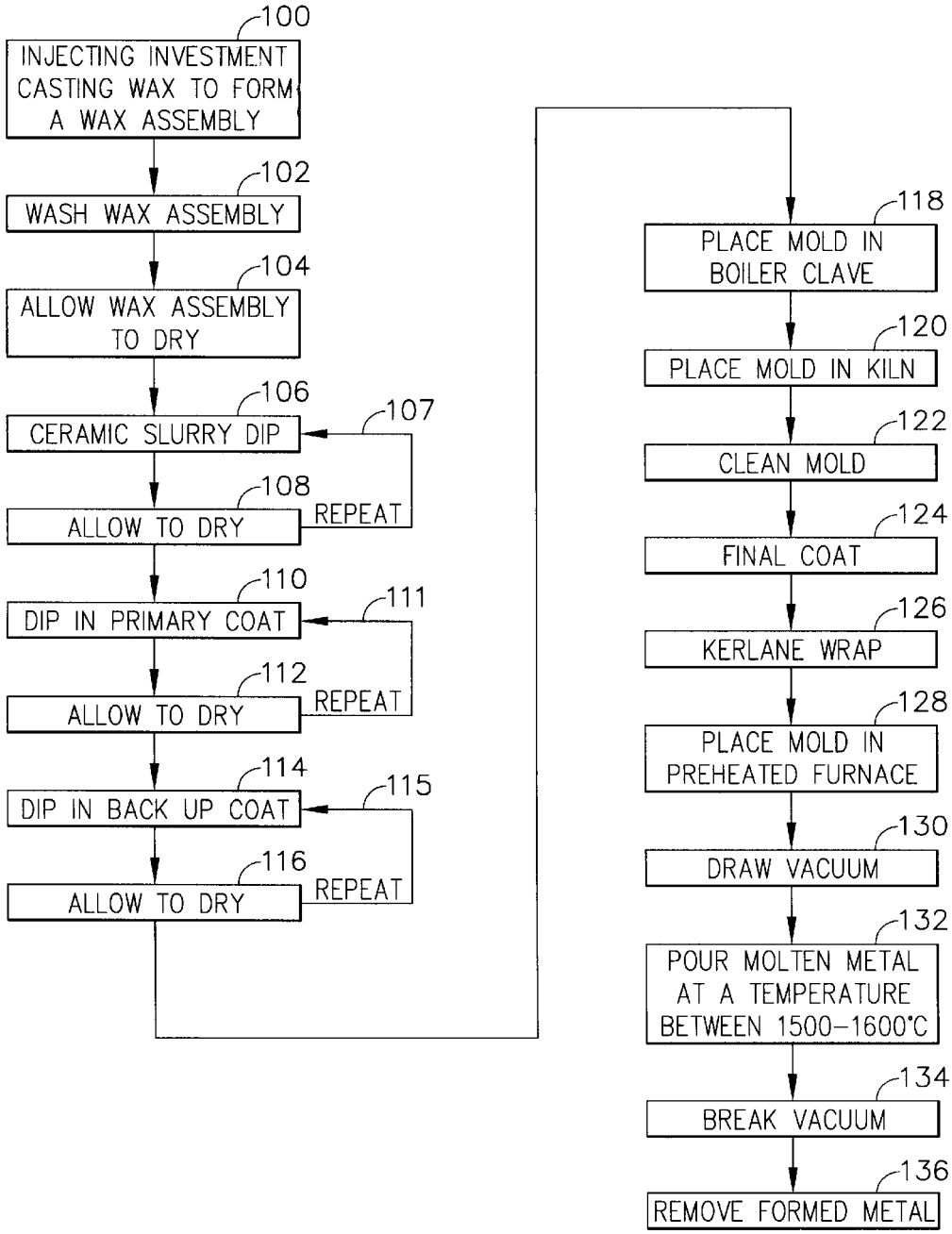
FIG. 1 is a flowchart of a method of forming a metal article according to the present invention.

The present invention may be used to create any metal article with a thin portion. However, it is particularly well suited for the investment casting industry, and particularly combustion cases for use in gas turbines. The present invention differs from the prior art in that it is single-cast, allows for high temperature, thinwall structures with shorter pour time and thus reduced cycle time providing a quick, relatively inexpensive, not labor intensive method which improves current quality and may be used with traditional equiaxed investment casting technology. A method for casting a metal combustion case is disclosed as shown in FIG. 1. The method may comprise the steps of injecting investment casting wax into a metal wax injection die to form a wax assembly (100), washing the wax assembly (102) and allowing it to dry (104). The wax assembly may then be dipped in a ceramic slurry (106), allowed to dry (108) and repeated (107). According to a one embodiment, the wax assembly is dipped in a ceramic slurry a minimum of seven times and preferably nine times. The wax assembly may be dipped in a primary coat (110) and allowed to dry (112). The primary coat may be zircon. This may repeated (111), dipping in a primary coat (110) and allowing to dry (112). It should be understood that the method may include either a ceramic slurry dip or a dip in a primary coat or both. A number of variations are envisioned such as two ceramic slurry dips, then seven primary coat dips. Then the wax assembly may be dipped in at least one backup coat (114), and the backup coat allowed to dry (116). The backup coat may be molochite. This process may be repeated (115) as many times as necessary to achieve the desired thickness and stability . The result may be a mold with a mold cavity.

The mold may then be placed in a Boilverclave (118), then in a Dewax kiln (120) to dewax the mold. Boilerclaves are well known within the art, and any standard Boilerclave may be utilized. The Dewax kiln may also be any Dewax Kiln known within the art. By way of example, the Dewax Kiln may be that produced by Pacific Kiln. The 1400° F. to 1600° F. heat may quickly penetrate the ceramic shell and melt the wax pattern from the outside in, eliminating the potential shell cracking from wax expansion. The wax may drain through a tube in the floor into an extinguishing/cooling chamber and may be allowed to collect in a holding tank. This results in cleaning the mold (122) The mold may then be coated with a final coat (124). The mold may also be wrapped (126) in a ceramic fibre material, such as Kerlane™. The mold may be positioned in a preheated furnace (128) so that the furnace substantially surrounds the mold and so that a longitudinal axis of the long thin portion of the mold cavity is in an upright orientation and heated to a temperature between 1045° C. and 1055° C. A vacuum may be drawn (130), and a nickel based alloy metal heated until it forms a molten metal, this molten metal may be poured (132) at a temperature between 1500° C. and 1600° C., preferably between 1560° C. and 1570° C. into the mold cavity, the vacuum broken (134) and the mold withdrawn (136). The molten metal may be allowed to solidify so as form a combustion case metal article with a equiaxed grain structure.

Figure 2:
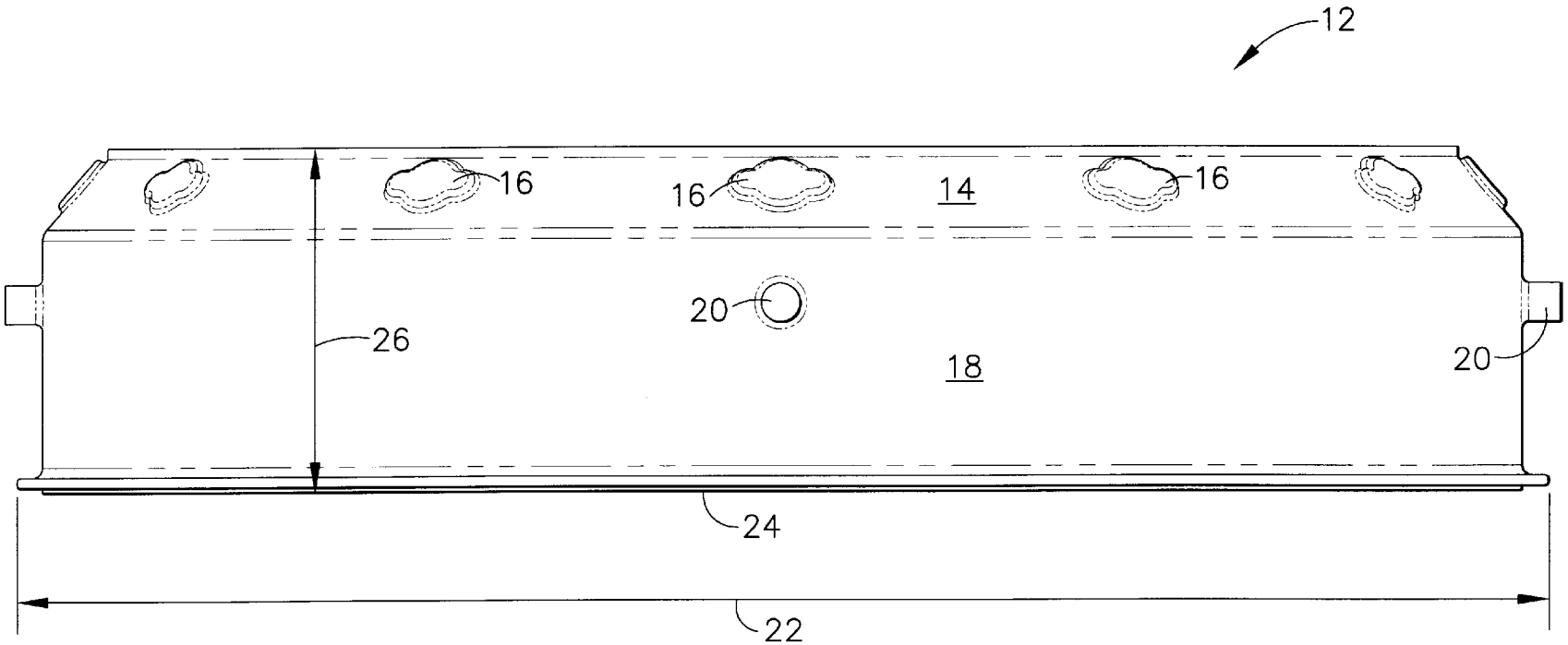
FIG. 2 is a side view of a metal article according to the present invention.

FIG. 2 depicts a metal article that may be formed according to one aspect of the present invention. It should be understood that the metal article corresponds to the mold cavity, having the corresponding shape as would be expected. The metal article shown is a combustion case (12), with a corresponding base wall portion (14) with a thickness of approximately ¼ inch, and twelve gates (not visible). The metal article may have twelve atomizers (16), and gate ratio of the atomizer may be between 1.7–1.9 to 1. The corresponding thinwall portion 18 is 0.032 inches thick. There may be four bosses (20) with gate ratios of 1.9–2.1 to 1. A boss and atomizers serve to provide areas that are thicker to provide a stable area in which items, such as metal screws, may be attached. The outer diameter (22) may range between 15 and 20 inches. Along the thinwall portion (24), there may be twelve gated faces (not visible). The metal article may have a height (26), thinwall portion (24), and a base wall portion (14). The height (26) of the metal article formed in the mold cavity may be between 6 and 9 inches. The base wall portion (14) may have a thickness less than 10 times the thickness of the thinwall portion (24) and at least one gate. The base wall portion may be between 0.20 and 0.35 inches thick. The thinwall portion (24) may be less than 0.05 inches thick and free of gating. There may also be at least one atomizer (16), at least one gate, and at least one boss.

Figure 3A:
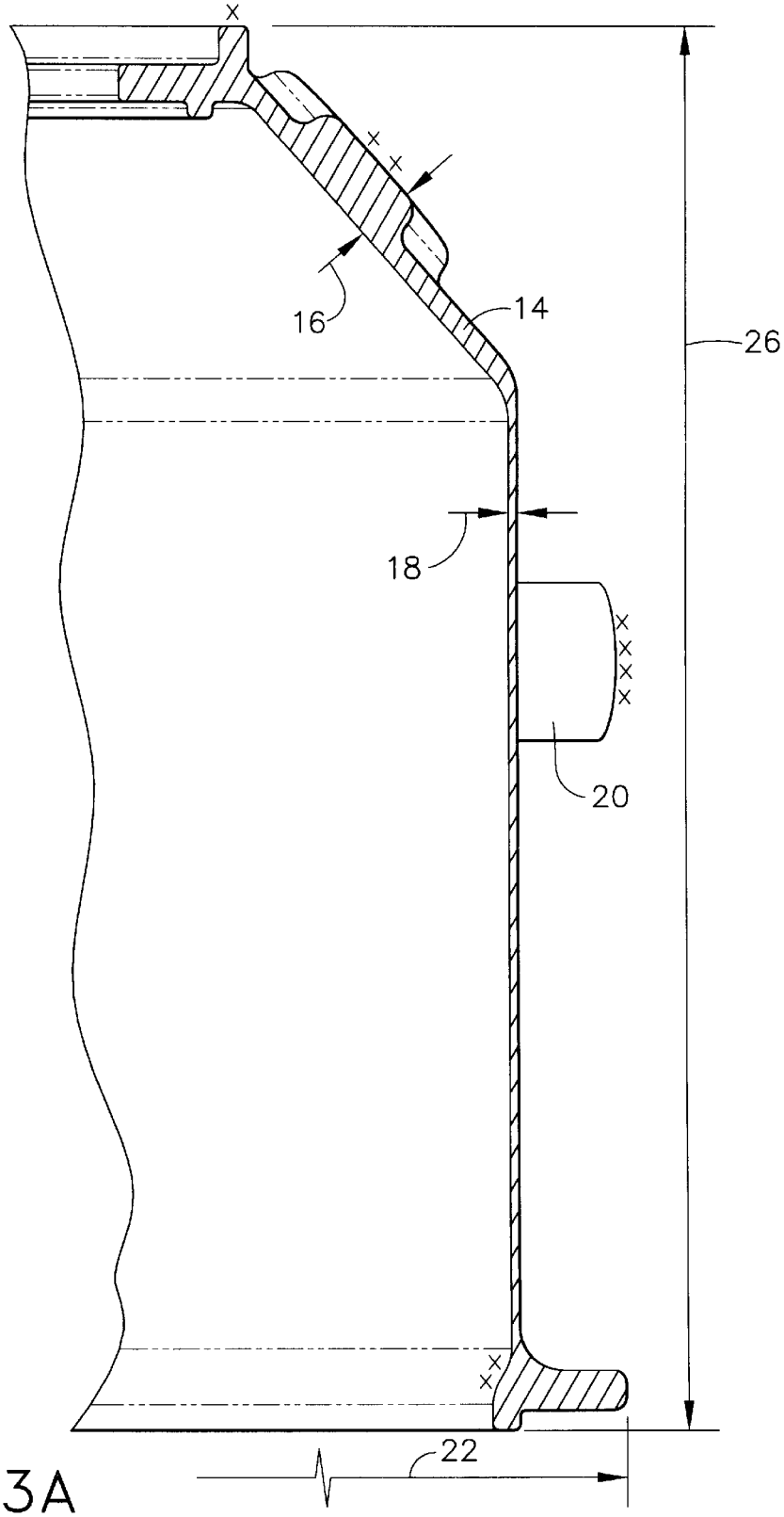
FIG. 3A is a sectional view of a metal article according to the present invention.
Figure 3B:
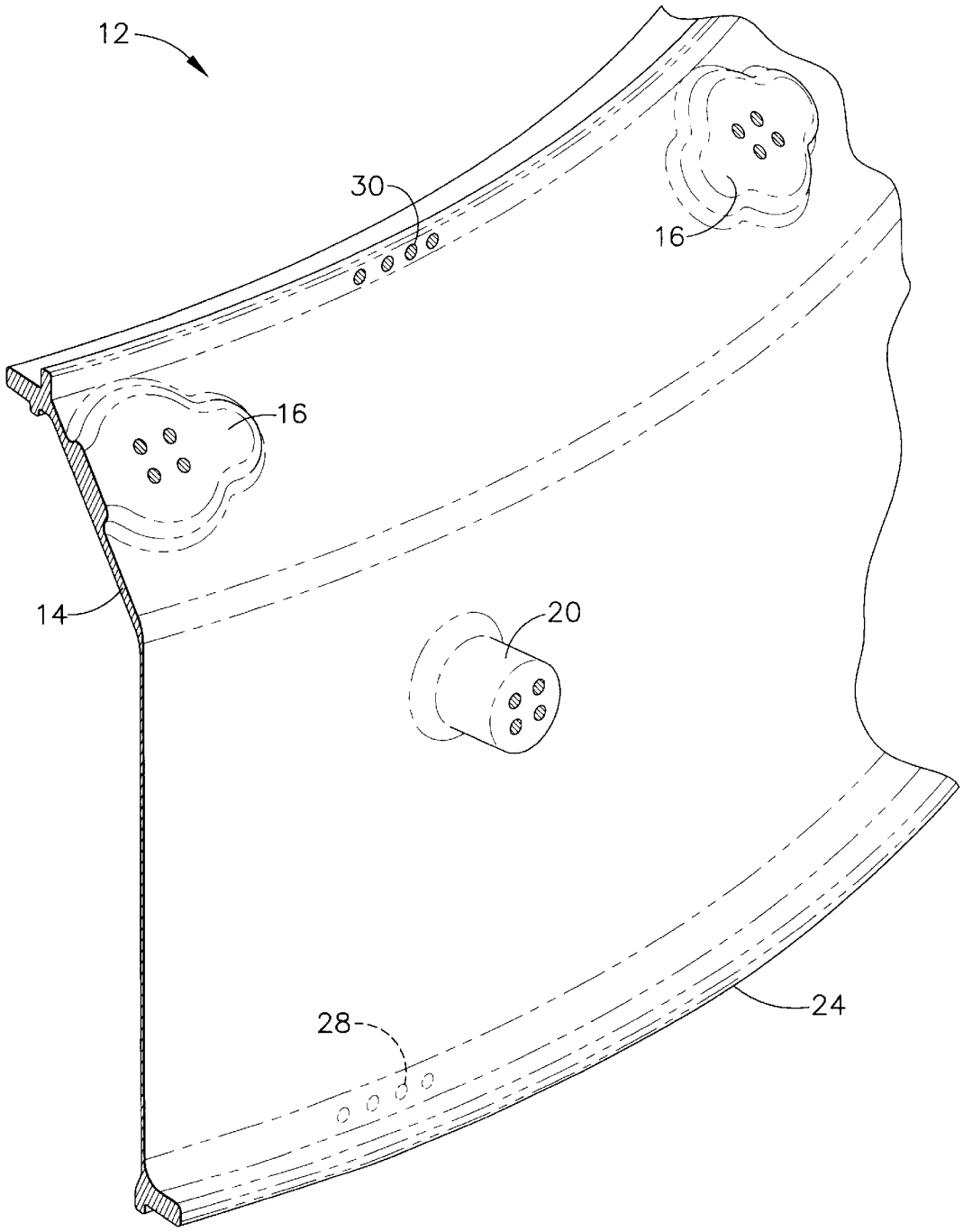
FIG. 3B is a perspective view of a metal article according to the present invention.

FIGS. 3A and 3B depict a sectional and perspective view of the same metal article made employing the methods according to the present invention. As shown, the thinwall portion 18 may be 0.032 inches thick. There are four bosses with gate ratios between 1.9–2.1 to 1. A gate ratio is the ratio of the point of entry to the boss size. The height 26 may be between six and nine inches tall. The outer diameter 22 may be between 15 and 20 inches. There may be gates 28 along the inside faces. According to the embodiment shown, there is gating on the inside faces in twelve places, with ratios between 1.9–2.1 to 1. Along the base wall portion 14 there may be twelve atomisers 16 Atomizers and bosses serve the same purpose, to provide thicker areas for stability and for attaching items to. The atomizers 16 may have gate ratios of 1.7–1.9 to 1. There may be gated faces 28 in twelve places along the thinwall edge 24.

It should be understood, of course, that the foregoing relates to preferred embodiments of the invention and that modifications may be made without departing from the spirit and scope of the invention as set forth in the following claims.

We claim:

1. A method for casting a metal article, comprising the steps of:

forming a mold having a mold cavity, said mold cavity having a height, a thinwall portion, a base wall portion with a thickness less than 10 times the thickness of the thinwall portion and with at least one gate, wherein said thinwall portion is less than 0.05 inches thick and free of gating;

positioning the mold in a preheated furnace so that the furnace substantially surrounds the mold and so that a longitudinal axis of the long thin portion of the mold cavity is in an upright orientation;

heating said mold in said furnace to a temperature between 1045° C. and 1055° C.;

drawing a vacuum in said furnace;

heating a metal until it forms a molten metal;

pouring said molten metal with a temperature between 1560° and 1570° C. into the mold cavity;

breaking said vacuum;

withdrawing said mold cavity, wherein said molten metal has been poured; and solidifying said molten metal in said mold cavity so as to cause said molten metal to solidify with an equiaxed grain structure.

2. A method as in claim 1, wherein said thinwall portion is between 0.029 and 0.032 inches thick.

3. A method as in claim 1, wherein said base wall portion is between 0.20 and 0.35 inches thick.

4. A method as in claim 1, wherein said mold cavity has a height between 6 and 9 inches.

5. A method as in claim 1, wherein said mold cavity further comprises an indentation suitable for forming at least one atomiser.

6. A method as in claim 1, wherein said mold cavity further comprises an indentation suitable for forming at least one gate.

7. A method as in claim 1, wherein said mold cavity further comprises an indentation suitable for forming at least one boss.

8. A method for casting a metal article, comprising the steps of:

injecting investment casting wax into a metal wax injection die to form a wax assembly;

repeatedly dipping said wax assembly in a ceramic slurry and allowing to dry at least two times, resulting in a mold with a mold cavity having an outer diameter, height, thinwall portion, a base wall portion with at least two gates, wherein said thinwall portion is less than 0.05 inches thick and free of gating;

cleaning said mold;

coating said mold with a final coat;

positioning said mold in a preheated furnace so that the furnace substantially surrounds the mold and so that a longitudinal axis of the long thin portion of the mold cavity is in an upright orientation;

heating said mold in said furnace;

drawing a vacuum in said furnace;

heating a metal until it forms a molten metal;

pouring said molten metal into the mold cavity;

breaking said vacuum;

withdrawing said mold, wherein said molten metal has been poured; and solidifying said molten metal in said mold cavity so as to cause said molten metal to solidify to form a metal article with an equiaxed grain structure.

9. A method as in claim 8, further comprising the step of wrapping said mold in a ceramic fibre material after coating said mold with a final coat.

10. A method as in claim 8, further comprising the step of wrapping said mold in a porous silica after coating said mold with a final coat.

11. A method as in claim 8, wherein said outer diameter is between 15 and 20 inches.

12. A method as in claim 8, wherein said height is between 6 and 9 inches.

13. A method as in claim 8, wherein said base wall portion is between 0.20 and 0.30 inches thick.

14. A method as in claim 8, further comprising twelve gates between twelve atomisers.

15. A method as in claim 8, wherein said thinwall portion is less than 0.035 inches thick and free of gating.

16. A method as in claim 8, wherein said step of cleaning said mold further comprises the steps of:

placing said mold in a Boilverclave; and placing said mold in a Dewax kiln.

17. A method as in claim 8, wherein said step of pouring said molten metal is at a temperature between 1560° and 1570° C.

18. A method as in claim 8, wherein said step of heating said mold in said furnace is at a temperature between 1045° C. and 1055° C.

19. A method for casting a metal combustion case, comprising the steps of:

injecting investment casting wax into a metal wax injection die to form a wax assembly;

washing said wax assembly;

drying said wax assembly;

dipping said wax assembly in a primary coat;

allowing said primary coat to dry;

dipping said wax assembly in at least one backup coat;

allowing said backup coat to dry, resulting in a mold with a mold cavity having an outer diameter between 12 and 22 inches, a height between 5 and 10 inches, a thinwall portion with a thickness less than 0.035 inches and free of gating, a base wall portion with a thickness less than 0.30 inches and with twelve gates and twelve atomisers, wherein said twelve gates are between said twelve atomisers;

placing said mold in a Boilverclave; and placing said mold in a Dewax kiln;

coating said mold with a final coat;

wrapping said mold in Kerlane;

positioning said mold in a preheated furnace so that the furnace substantially surrounds the mold and so that a longitudinal axis of the long thin portion of the mold cavity is in an upright orientation;

heating said mold in said furnace to a temperature between 1045° C. and 1055° C.;

drawing a vacuum in said furnace;

heating a nickel based alloy metal until it forms a molten metal;

pouring said molten metal at a temperature between 1560° C. and 1570° C. into the mold cavity;

breaking said vacuum;

withdrawing said mold, wherein said molten metal has been poured; and solidifying said molten metal in said mold cavity so as to cause said molten metal to solidify to form a metal article with an equiaxed grain structure.

20. A method for casting a metal combustion case for use within a gas turbine engine, comprising the steps of:

injecting investment casting wax into a metal wax injection die to form a wax assembly;

washing said wax assembly;

drying said wax assembly;

dipping said wax assembly in a primary coat;

allowing said primary coat to dry;

dipping said wax assembly in at least one backup coat;

allowing said backup coat to dry, resulting in a mold with a mold cavity having a height, a thinwall portion less than 0.05 inches thick and free of gating and a base wall portion with a thickness less than 10 times the thickness of the thinwall portion and having at least one gate;

placing said mold in a Boilverclave; and placing said mold in a Dewax kiln;

coating said mold with a final coat;

wrapping said mold in Kerlane;

positioning said mold in a preheated furnace so that the furnace substantially surrounds the mold and so that a longitudinal axis of the long thin portion of the mold cavity is in an upright orientation;

heating said mold in said furnace to a temperature between 1045° C. and 1055° C.;

drawing a vacuum in said furnace;

heating a nickel based alloy metal until it forms a molten metal;

pouring said molten metal at a temperature between 1560° C. and 1570° C. into the mold cavity;

breaking said vacuum;

withdrawing said mold, wherein said molten metal has been poured; and solidifying said molten metal in said mold cavity so as to cause said molten metal to solidify to form a metal article with an equiaxed grain structure.

* * * * *